US010472909B2

(12) United States Patent
Xu et al.

(10) Patent No.: US 10,472,909 B2
(45) Date of Patent: Nov. 12, 2019

(54) FERROUS DISINTEGRABLE POWDER COMPACT, METHOD OF MAKING AND ARTICLE OF SAME

(71) Applicants: Zhiyue Xu, Cypress, TX (US); Zhihui Zhang, Katy, TX (US); Yingqing Xu, Tomball, TX (US)

(72) Inventors: Zhiyue Xu, Cypress, TX (US); Zhihui Zhang, Katy, TX (US); Yingqing Xu, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 879 days.

(21) Appl. No.: 14/882,600

(22) Filed: Oct. 14, 2015

(65) Prior Publication Data

US 2016/0032671 A1 Feb. 4, 2016

Related U.S. Application Data

(62) Division of application No. 13/794,957, filed on Mar. 12, 2013, now Pat. No. 9,803,439.

(51) Int. Cl.
*E21B 23/01* (2006.01)
*E21B 29/00* (2006.01)
(Continued)

(52) U.S. Cl.
CPC ..... *E21B 23/01* (2013.01); *B22F 1/025* (2013.01); *B22F 3/12* (2013.01); *B22F 5/003* (2013.01);
(Continued)

(58) Field of Classification Search
CPC ..... C22C 29/02; C22C 33/02; C23C 30/005; E21B 23/01
(Continued)

(56) References Cited

U.S. PATENT DOCUMENTS 3,368,882 A * 2/1968 Ellis ..... C22C 29/00 148/317
4,021,205 A 5/1977 Matsuda et al.
(Continued)

FOREIGN PATENT DOCUMENTS

JP 3111523 A 5/1991

OTHER PUBLICATIONS

ASM International, "Process Selection Guide," Surface Hardening of Steels: Understanding the Basics (#06952G), www.asminternational.org, ASM International, 2002, 16 pages.
(Continued)

*Primary Examiner* — Weiping Zhu
(74) *Attorney, Agent, or Firm* — Cantor Colburn LLP

(57) ABSTRACT

A process for preparing a disintegrable powder compact, the process comprises: combining: a primary particle comprising a ferrous alloy which comprises carbon; and a secondary particle to form a composition; compacting the composition to form a preform; and sintering the preform to form the disintegrable powder compact by forming a matrix from one of the primary particle or the secondary particle; and forming a plurality of dispersed particles from the other of the primary particle or the secondary particle, wherein the dispersed particles are dispersed in the matrix, the disintegrable powder compact is configured to disintegrate in response to contact with a disintegration fluid, and the primary particle and secondary particle have different standard electrode potentials.

16 Claims, 6 Drawing Sheets

(51) Int. Cl.

| | |
|---|---|
| ***B22F 1/02*** | (2006.01) |
| ***C22C 33/02*** | (2006.01) |
| ***B22F 3/12*** | (2006.01) |
| ***B22F 5/00*** | (2006.01) |

(52) U.S. Cl.
CPC ..... *C22C 33/02* (2013.01); *E21B 29/00* (2013.01); *B22F 2998/10* (2013.01)

(58) Field of Classification Search
USPC ..... 75/228
See application file for complete search history.

(56) References Cited

U.S. PATENT DOCUMENTS

| | | | |
|---|---|---|---|
| 4,678,510 | A | 7/1987 | Jandeska, Jr. et al. |
| 5,759,227 | A | 6/1998 | Takahashi et al. |
| 8,535,604 | B1 | 9/2013 | Baker et al. |
| 2011/0132143 | A1 | 6/2011 | Xu et al. |
| 2011/0135530 | A1 | 6/2011 | Xu et al. |
| 2011/0212339 | A1 | 9/2011 | Binder et al. |
| 2012/0103135 | A1 | 5/2012 | Xu et al. |
| 2013/0047784 | A1 | 2/2013 | Xu et al. |
| 2013/0052472 | A1 | 2/2013 | Xu et al. |
| 2013/0186647 | A1 | 7/2013 | Xu et al. |
| 2014/0262327 | A1 | 9/2014 | Xu et al. |

OTHER PUBLICATIONS

Notification of Transmittal of the International Search Report and the Written Opinion of the International Searching Authority, or the Declaration; PCT/US2014/013567; dated May 14, 2014, 12 pages.

* cited by examiner

FERROUS DISINTEGRABLE POWDER COMPACT, METHOD OF MAKING AND ARTICLE OF SAME

CROSS REFERENCE TO RELATED APPLICATIONS

This application is a divisional of U.S. application Ser. No. 13/794,957 filed Mar. 12, 2013, the disclosure of which is incorporated by reference herein in its entirety.

BACKGROUND

Oil and natural gas wells often utilize wellbore components or tools that, due to their function, are only required to have limited service lives that are considerably less than the service life of the well. After a component or tool service function is complete, it must be removed or disposed of in order to recover the original size of the fluid pathway for use, including hydrocarbon production, $CO_2$ sequestration, etc. Disposal of components or tools has conventionally been done by milling or drilling the component or tool out of the wellbore, which are generally time consuming and expensive operations.

In order to eliminate the need for milling or drilling operations, the removal of components or tools by dissolution of degradable polylactic polymers using various wellbore fluids has been proposed. However, these polymers generally do not have the mechanical strength, fracture toughness, or other mechanical properties necessary to perform the functions of wellbore components or tools over the operating temperature range of the wellbore, therefore, their application has been limited.

Other degradable materials have been proposed including certain degradable metal alloys formed from certain reactive metals in a major portion, such as aluminum, together with other alloy constituents in a minor portion, such as gallium, indium, bismuth, tin or combinations thereof, and without excluding certain secondary alloying elements, such as zinc, copper, silver, or combinations thereof. These materials can be formed by melting powders of the constituents and then solidifying the melt to form the alloy. That is, each constituent metal is melted and solidified together, without any physical separation among the constituents of the resultant alloy except as characterized by phase diagrams. These materials include many combinations that utilize metals, such as lead, cadmium, and the like that may not be suitable for release into the environment in conjunction with the degradation of the material. Also, their formation can involve various melting phenomena that result in alloy structures that are dictated by the phase equilibria and solidification characteristics of the respective alloy constituents and that may not result in optimal or desirable alloy microstructures, mechanical properties, or dissolution characteristics.

Therefore, the development of materials that can be used to form wellbore components and tools having the mechanical properties necessary to perform their intended function and then removed from the wellbore by controlled disintegration using wellbore fluids is very desirable.

BRIEF DESCRIPTION

In an embodiment, a process for preparing a disintegrable powder compact, the process comprises: combining a primary particle comprising a ferrous alloy which comprises carbon; and a secondary particle to form a composition; compacting the composition to form a preform; and sintering the preform to form the disintegrable powder compact by forming a matrix from one of the primary particle or the secondary particle; and forming a plurality of dispersed particles from the other of the primary particle or the secondary particle, wherein the dispersed particles are dispersed in the matrix, the disintegrable powder compact is configured to disintegrate in response to contact with a disintegration fluid, and the primary particle and secondary particle have different standard electrode potentials.

In a further embodiment, a process for removing a slip, the process comprises: contacting the slip with a disintegrating fluid, the slip comprising a disintegrable powder compact which comprises: a matrix; a plurality of dispersed particles comprising a particle core material dispersed in the matrix; a ferrous alloy comprising carbon disposed in one of the matrix or particle core material; and a secondary element disposed in the other of the matrix or particle core material, the matrix and plurality of dispersed particles having different standard electrode potentials.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments is presented herein by way of exemplification and not limitation.

It has been found that powder metal compacts made of ferrous alloys containing carbon can beneficially be used for disintegrable articles. Such a disintegrable material is lightweight, can be magnetic or nonmagnetic, and has a large strength and hardness, which is greater than, e.g., magnesium based alloys or composites. The implant herein disintegrates with a controlled rate of corrosion. Moreover, the powder metal compact has a composition and microstructure that can be configured at the micro or nanoscale to control the material strength, ductility, or disintegration rate.

Furthermore, the powder metal compact herein can be made by powder metallurgy by consolidating metal powders that also can be coated with a metal element. The composition and microstructure of the powder metal compact thus is configured at the micro or nanoscale for a select dissolution rate while establishing a uniformity of the exterior and interior structure. Hence, as the powder metal compact disintegrates, it retains strength in the remaining portion throughout the disintegration period.

Moreover, the high strength, high ductility yet fully disintegrable powder metal compact can be made from materials that selectively and controllably disintegrate in response to contact with certain fluids, e.g., a downhole fluid. Such a disintegrable powder metal compact includes components that are selectively corrodible and have selectively tailorable disintegration rates and selectively tailorable material properties. Additionally, the disintegrable powder metal compact can have components that have varying compression, tensile strength, or disintegration rate. As used herein, "disintegrable" refers to a material, component, or article that is consumable, corrodible, degradable, dissolvable, weakenable, or otherwise removable. It is to be understood that use herein of the term "disintegrate," or any of its forms (e.g., "disintegration"), incorporates the stated meaning. Such a powder metal compact will be referred to herein as a disintegrable powder compact.

According to an embodiment, a disintegrable powder compact includes a matrix, a plurality of dispersed particles including a particle core material dispersed in the matrix, a ferrous alloy comprising carbon disposed in one of the matrix or particle core material, and a secondary element disposed in the other of the matrix or particle core material. The matrix and the plurality of dispersed particles have different standard electrode potentials. The disintegrable powder compact thus is configured to disintegrate in response to contact with a disintegration fluid.

Figure 1:
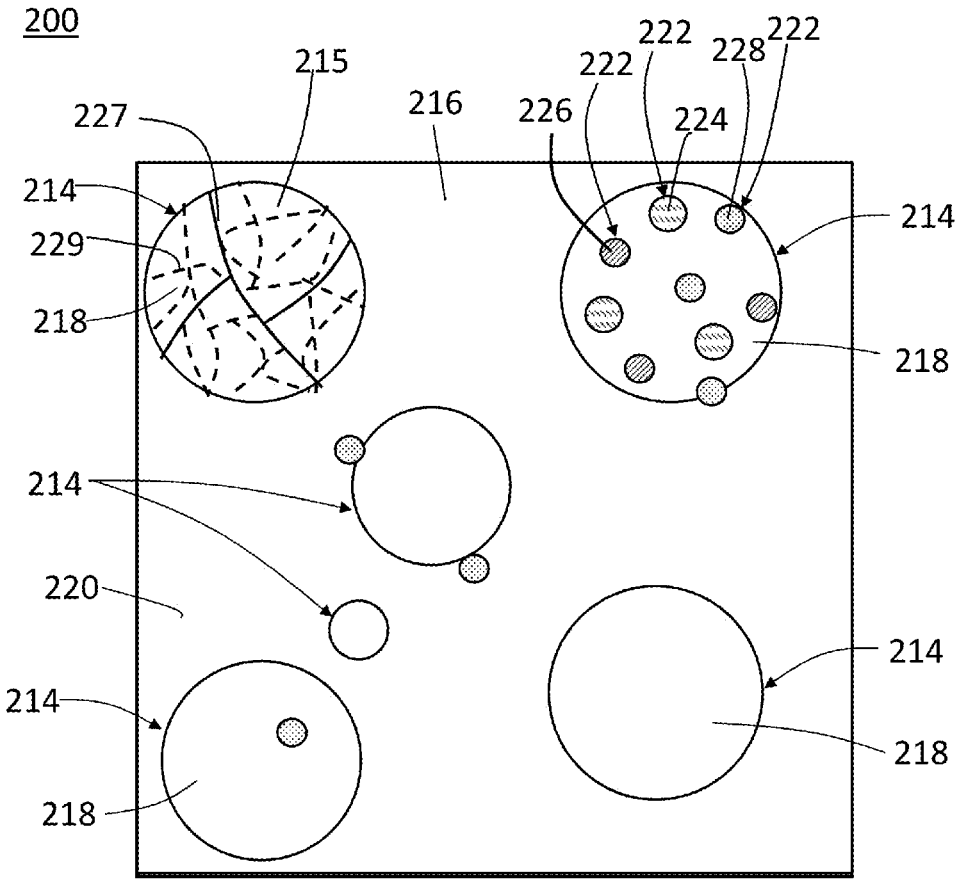
FIG. 1 shows a cross-section of a disintegrable powder compact.

As shown in FIG. 1, the disintegrable powder compact 200 includes a matrix 216 comprising a matrix material 220 and a plurality of dispersed particles 214. The dispersed particles 214 include a particle core material 218 dispersed in the matrix 216. The particle core material 218 can include a nanostructured material. Such a disintegrable powder compact having the matrix 216 with dispersed particles 214 disposed therein can be referred to as a ferrous disintegrable powder compact (DPC).

Figure 2:
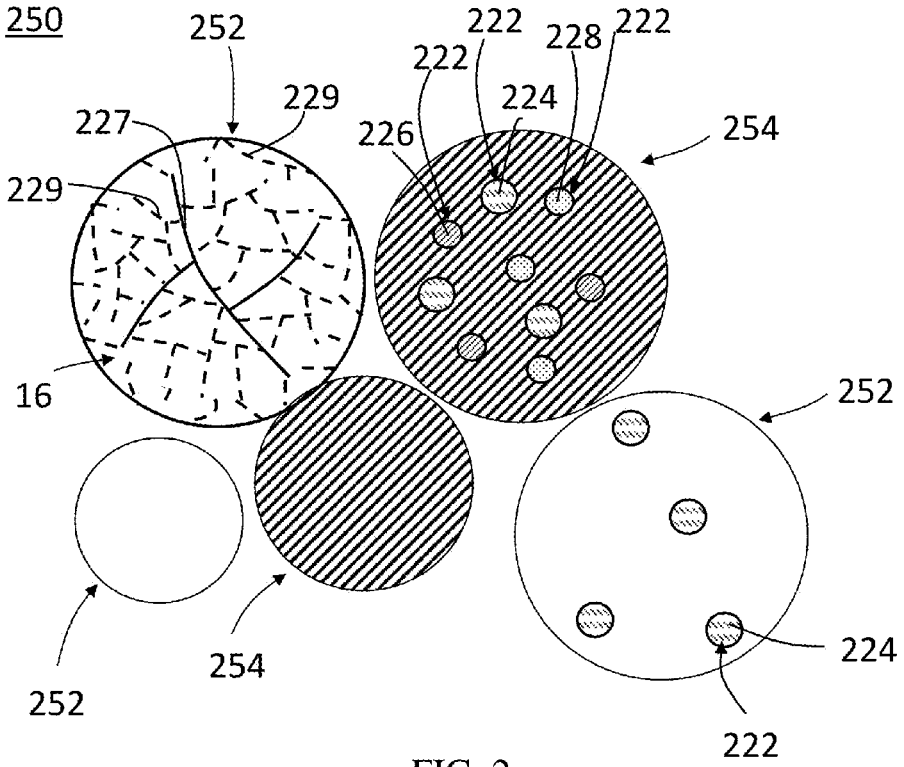
FIG. 2 shows a cross-section of a powder according to an embodiment herein.

With reference to FIGS. 1 and 2, dispersed particles 214 can include any suitable metallic particle core material 218 that includes nanostructure as described herein. In an exemplary embodiment, the disintegrable powder compact 200 is formed from a powder 250 (FIG. 2) of a primary particle 252 and a secondary particle 254. The primary particle 252 includes a ferrous alloy comprising carbon, and the secondary particle includes a secondary element. In one embodiment, the dispersed particle 214 and particle core material 218 are formed from the primary particle 252, and the matrix 216 and matrix material 220 are formed from the secondary particle 254. In another embodiment, the dispersed particle 214 and particle core material 218 are formed from the secondary particle 254, and the matrix 216 and matrix material 220 are formed from the primary particle 252. Thus, the ferrous alloy comprising carbon is disposed in one of the matrix 216 or particle core material 218, and the secondary element is disposed in the other of the matrix 216 or particle core material 218. Due to the powder metallurgical process used to form the disintegrable powder compact 200, one of the primary particle 252 or the secondary particle 254 forms the matrix 216 while the other particle (252 or 254) forms the dispersed particles 214.

The ferrous alloy comprising carbon can include, besides carbon and iron, an element such as aluminum, boron, bismuth, cobalt, copper, chromium, lead, manganese, molybdenum, nickel, niobium, nitrogen, phosphorous, selenium, silicon, sulfur, tantalum, tellurium, titanium, tungsten, vanadium, zirconium, a rare earth element (e.g., a lanthanide such as cerium and the like), or a combination thereof. In addition, the ferrous alloy can include an alloy steel (e.g., manganese steel, nickel steel, nickel-chromium steel, molybdenum steel, chromium-molybdenum steel, nickel-chromium-molybdenum steel, nickel-molybdenum steel, chromium steel, chromium vanadium steel, tungsten-chromium steel, silicon-manganese steel, boron steel, leaded steel, and the like), carbon steel (e.g., high carbon content steel, low carbon content steel, medium carbon content steel, spring steel, plain carbon steel, resulfurized steel, resulfurized and rephosphorized steel, and the like), cast iron (e.g., meehanite, spheroidal graphite iron, and the like), stainless steel (e.g., austenitic stainless steel, austenitic chromium-nickel-manganese stainless steel, austenitic chromium-nickel stainless steel, ferritic stainless steel, heat-resisting chromium stainless steel, martensitic stainless steel, martensitic precipitation hardening stainless steel, duplex stainless steel such as ferritic/austenitic stainless steel, and the like), tool steel (e.g., cold work tool steel, hot work tool steel, plastic mold tool steel, and the like), or a combination thereof. Exemplary ferrous alloys include those designated by SAE International (formerly the Society of Automotive Engineers) as alloy steel (SAE grade 4130, 4140, 4142, 4340, 5160, 6150, 8620, and the like), carbon steel (SAE grade 1018, 1045, 1095, 1140, 1146, 1215, 12L14, and the like), stainless steel (SAE grade 301, 303, 304, 305, 316, 317, 321, 409, 410, 420, 430, 440, 904, and the like), tool steel (SAE grade A-2, A-3, A-4, A-5, A-6, A-7, A-8, A-9, D-1, H-13, M-2, M-3, M-4, M-5, M-6, M-7, O-1, S-5, and the like), and the like. In one embodiment, the ferrous alloy comprising carbon is a chromium, molybdenum, vanadium tool steel that also contains silicon, and magnesium.

The ferrous alloy comprising carbon can have various microstructures such as bainite, ledeburite, pearlite, spheroidite, tempered martensite, or a combination thereof. Moreover, the ferrous alloy comprising carbon also can have a phase such as ferrite, austentite, cementite, graphite, martensite, ε-carbide, or a combination thereof.

The carbon can be present in the ferrous alloy in an amount from 0.005 weight percent (wt %) to 5 wt %, specifically 0.005 wt % to 3 wt %, and more specifically 0.1 wt % to 2.5 wt %, based on a weight of the ferrous alloy particles. The iron can be present in the ferrous alloy in an amount from 50 wt % to 99.99 wt %, specifically 75 wt % to 99.9 wt %, and more specifically 80 wt % to 97.5 wt %, based on the weight of the ferrous alloy particles. Other elements, besides iron and carbon, can be present in the ferrous alloy in an amount from 0 wt % to 47.5 wt %, specifically 0 wt % to 25 wt %, more specifically 0 wt % to 10 wt %, further specifically 0 wt % to 5 wt %, yet more specifically 0 wt % to 2 wt %, and even more specifically 0 wt % to 1 wt %, based on the weight of the ferrous alloy particles.

The secondary element, which is disposed in the secondary particle 254 of powder 250, can include an element such as aluminum, calcium, cobalt, copper, iron, magnesium, manganese, molybdenum, nickel, silicon, zinc, a rare earth element, or a combination thereof. As used herein, "secondary element" refers to a single element or combination of elements such as a mixture, alloy, or a plurality of different elements, which can be covalently bonded together. In one embodiment, the secondary particle 254 includes a secondary element that is magnesium. In another exemplary embodiment, the secondary particle 254 includes a secondary element that is various Mg alloys, including various precipitation hardenable alloys, e.g., a precipitation hardenable Mg alloy. In some embodiments, the secondary element includes magnesium and an alloying element (e.g., aluminum, zinc, calcium, yttrium, zinc, and the like) where the alloying element is present in an amount from 0.1 weight percent (wt %) to 15 wt %, specifically 0.1 wt % to 10 wt %, more specifically 0.1 wt % to 5 wt %, and yet more specifically 0.1 wt % to 2 wt %, based on the weight of the secondary particle, the balance of the weight being, the secondary element, e.g., magnesium.

According to an embodiment, the magnesium alloy can include the following magnesium series of alloys AZ, AM, HK, HM, HZ, M, QE, QH, WE, ZC, ZE, ZK, or a combination thereof. In an additional embodiment, precipitation hardenable Mg alloys are particularly useful because they can strengthen the secondary particle 254 through both nanostructuring and precipitation hardening through the incorporation of particle precipitates as described herein.

The dispersed particle 214 and particle core material 218 or matrix 216 also can include a rare earth element, or a combination of rare earth elements. Exemplary rare earth elements include Sc, Y, La, Ce, Pr, Nd, Er, and the like. A combination comprising at least one of the foregoing rare earth elements can be used. Where present, the rare earth element can be present in an amount from 5 wt % or less, specifically 2 wt % or less, and more specifically 0.01 wt % to 2 wt %, based on the weight of the disintegrable powder compact.

The dispersed particle 214 and particle core material 218 also can include a nanostructured material 215. In an exemplary embodiment, the nanostructured material 215 is a material having a grain size (e.g., a subgrain or crystallite size) that is less than 200 nanometers (nm), specifically 10 nm to 200 nm, and more specifically an average grain size less than 100 nm. The nanostructure of the dispersed particle 214 can include high angle boundaries 227, which usually are used to define the grain size, or low angle boundaries 229 that can occur as substructure within a particular grain, which are sometimes used to define a crystallite size, or a combination thereof. It should be appreciated that the matrix 216 and grain structure (nanostructured material 215 including grain boundaries 227 and 229) of the dispersed particle 214 are distinct features of the disintegrable powder compact 200. Particularly, matrix 216 is not part of a crystalline or amorphous portion of the dispersed particle 214. That is, the matrix 216 is external to and is not part of the grain structure of the dispersed particle 214. Consequently, the dispersed particle 214 and the matrix 216 contact each other at an interfacial boundary region although atoms from either the dispersed particle 214 or the matrix 216 can diffuse during production of the disintegrable powder compact.

In an embodiment, the disintegrable powder compact 200 can also include an optional disintegration agent. The disintegration agent is disposed in the dispersed particle 214. In another embodiment, the disintegration agent is disposed external to the dispersed particle 214. In yet another embodiment, the disintegration agent is disposed in the dispersed particle 214 as well as external to the dispersed particle 214. The disintegrable powder compact 200 also includes the matrix 216 that comprises a metallic matrix material 220. The disintegration agent can be disposed in the matrix 216 among the metallic matrix material 220. An exemplary powder metal compact and method used to make the powder metal compact are disclosed in U.S. patent application Ser. Nos. 12/633,682, 12/633,688, 13/220,832, 13/220,822, and 13/358,307, the disclosure of each patent application is incorporated herein by reference in its entirety.

The disintegration agent can be included in the disintegrable powder compact 200 to control the disintegration rate of the disintegrable powder compact 200. The disintegration agent can be disposed in the dispersed particle 214, the matrix 216, or a combination thereof. According to an embodiment, the disintegration agent includes a metal, fatty acid, ceramic particle, or a combination thereof, the disintegration agent being disposed among the controlled electrolytic material to change the disintegration rate of the controlled electrolytic metallic material of the disintegrable powder compact. In one embodiment, the disintegration agent is disposed in the matrix 216 external to the dispersed particle 214. In an embodiment, the disintegration agent increases the disintegration rate of the disintegrable powder compact 200. In another embodiment, the disintegration agent decreases the disintegration rate of the disintegrable powder compact 200. The disintegration agent can be a metal including cobalt, copper, iron, nickel, tungsten, zinc, or a combination thereof. In a further embodiment, the disintegration agent is the fatty acid, e.g., fatty acids having 6 to 40 carbon atoms. Exemplary fatty acids include oleic acid, stearic acid, lauric acid, hyroxystearic acid, behenic acid, arachidonic acid, linoleic acid, linolenic acid, recinoleic acid, palmitic acid, montanic acid, or a combination thereof. In yet another embodiment, the disintegration agent is ceramic particles such as boron nitride, tungsten carbide, tantalum carbide, titanium carbide, niobium carbide, zirconium carbide, boron carbide, hafnium carbide, silicon carbide, niobium boron carbide, aluminum nitride, titanium nitride, zirconium nitride, tantalum nitride, or a combination thereof. Additionally, the ceramic particle can be one of the ceramic materials discussed below with regard to the strengthening agent. Such ceramic particles have a size of 5 μm or less, specifically 2 μm or less, and more specifically 1 μm or less. The disintegration agent can be present in an amount effective to cause disintegration of the disintegrable powder compact 200 at a desired disintegration rate, specifically about 0.25 wt % to 15 wt %, specifically 0.25 wt % to 10 wt %, specifically 0.25 wt % to 1 wt %, based on the weight of the disintegrable powder compact.

In an exemplary embodiment, the matrix 216 includes aluminum, calcium, cobalt, copper, iron, magnesium, manganese, molybdenum, nickel, silicon, tungsten, zinc, a rare earth element, an oxide thereof, a nitride thereof, a carbide thereof, an intermetallic compound thereof, a cermet thereof, or a combination thereof. The dispersed particle 214 can be present in an amount from 50 wt % to 95 wt %, specifically 60 wt % to 95 wt %, and more specifically 70 wt % to 95 wt %, based on the weight of the disintegrable powder compact. Further, the metal matrix material can be present in an amount from 5 wt % to 70 wt %, specifically 10 wt % to 60 wt %, and more specifically 10 wt % to 30 wt %, based on the weight of the disintegrable powder compact.

In another embodiment, the disintegrable powder compact includes other particles that are dispersed in the matrix in addition to the dispersed particles 214. The disintegrable powder compact can include a plurality of secondary particles dispersed in the matrix. The secondary particles are different from the dispersed particles and the matrix and include an element such as aluminum, calcium, cobalt, copper, iron, magnesium, manganese, molybdenum, nickel, silicon, tungsten, zinc, a rare earth element, ferrous alloy, an oxide thereof, nitride thereof, carbide thereof, intermetallic compound thereof, cermet thereof, or a combination thereof.

Referring again to FIG. 1, the dispersed particle 214 and particle core material 218 also can include an additive particle 222. The additive particle 222 provides a dispersion strengthening mechanism to the dispersed particle 214 and provides an obstacle to, or serves to restrict, the movement of dislocations within individual particles of the dispersed particle 214. Additionally, the additive particle 222 can be disposed in the matrix 216 to strengthen the disintegrable powder compact 200. The additive particle 222 can have any suitable size and, in an exemplary embodiment, can have an average particle size from 10 nm to 1 micrometer (μm), and specifically 50 nm to 200 nm. Here, size refers to the largest linear dimension of the additive particle. The additive particle 222 can include any suitable form of particle, including an embedded particle 224, a precipitate particle 226, or a dispersoid particle 228. Embedded particle 224 can include any suitable embedded particle, including various hard particles. The embedded particle can include various metal, carbon, metal oxide, metal nitride, metal carbide, intermetallic compound, cermet particle, or a combination thereof. In an exemplary embodiment, hard particles can include aluminum, calcium, cobalt, copper, iron, magnesium, manganese, molybdenum, nickel, silicon, tungsten, zinc, a rare earth element, ferrous alloy, an oxide thereof, nitride thereof, carbide thereof, intermetallic compound thereof, cermet thereof, or a combination thereof. The additive particle can be present in an amount from 0.5 wt % to 25 wt %, specifically 0.5 wt % to 20 wt %, and more specifically 0.5 wt % to 10 wt %, based on the weight of the disintegrable powder compact.

In disintegrable powder compact 200, the dispersed particle 214 can be dispersed throughout the matrix 216 and can have a spherical shape or spheroidal shape such as a prolate or oblate spheroidal shape. Moreover, the matrix 216 is substantially continuous to surround the dispersed particles 214 such that individual dispersed particles 214 do not directly contact one another, while in some embodiments a dispersed particle 214 directly contacts another dispersed particle 214 without interposed matrix 216 therebetween. The size of the particles that make up the dispersed particles 214 can be from 50 nm to 800 μm, specifically 500 nm to 600 μm, and more specifically 1 μm to 500 μm. The particle size of which can be monodisperse or polydisperse, and the particle size distribution can be unimodal or bimodal. Size here refers to the largest linear dimension of a particle.

Figure 3:
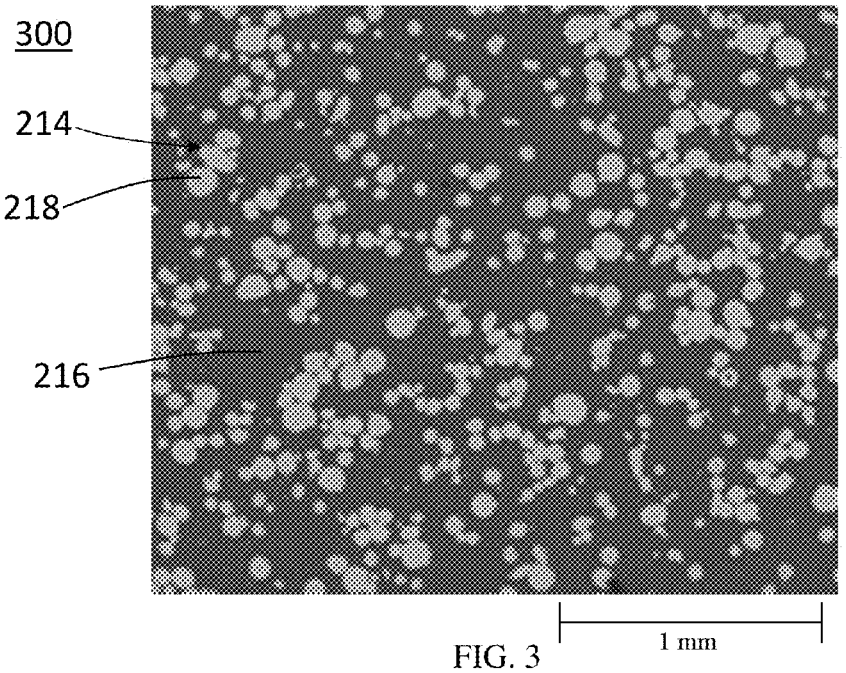
FIG. 3 is a photomicrograph of a powder compact according to an embodiment herein.

Referring to FIG. 3 a photomicrograph of an exemplary embodiment of a disintegrable powder compact is shown. The disintegrable powder compact 300 has a dispersed particle 214 that includes particles having a particle core material 218. Additionally, each particle of the dispersed particle 214 is disposed in a matrix 216. Here, the matrix 216 is shown as a network that substantially surrounds the dispersed particles 214.

Figure 4:
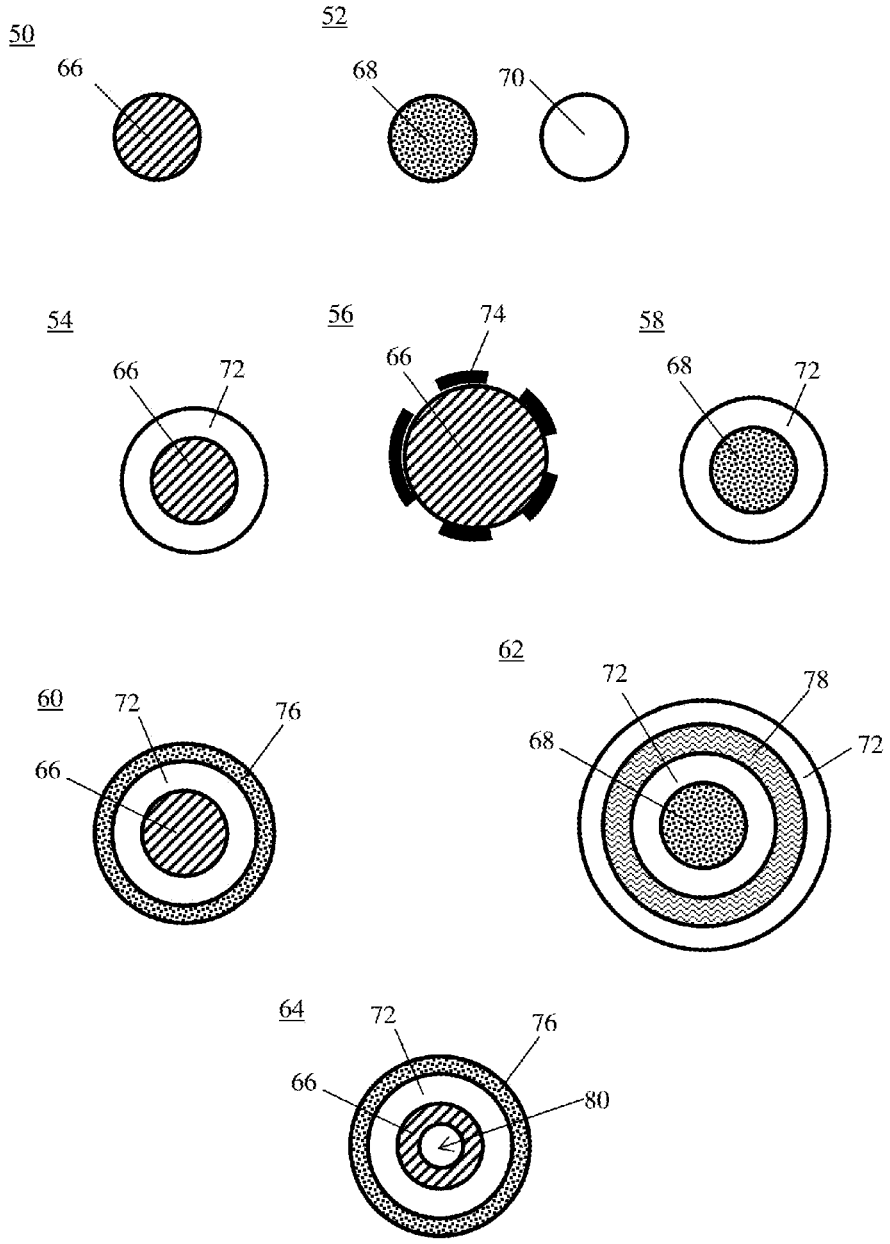
FIG. 4 shows a cross-section of powder particles according to an embodiment herein.

According to an embodiment, the metal compact is formed from a combination of, for example, powder constituents. As illustrated in FIG. 4, exemplary powder particles for making the disintegrable powder compact herein include various ferrous alloy particles (50,54, 56, 60, 64, and the like), secondary particles (52, 58, 62, and the like), or a combination thereof. Ferrous alloy particle 50 includes a ferrous alloy particle core material 66. Secondary particles 52 include a secondary element as the particle core materials 68, 70. Ferrous alloy particle 54 has a ferrous alloy particle core material 66 in its particle core and a metallic coating layer 72 that includes a secondary element. As in ferrous alloy particle 56, the coating can be a discontinuous coating 74 that includes a secondary element. The secondary particles (58, 62) can include a secondary element particle core 68 having a coating layer 72 including a secondary element. A plurality of coatings layers (72, 76, 78) that include a secondary element can be disposed on the ferrous alloy particle (60, 64) or secondary particle 62. According to an embodiment, the particle can include a hollow space 80 as in ferrous alloy particle 64. In an embodiment, a hollow space is disposed in at least a portion of the plurality of the dispersed particles of the disintegrable powder compact formed from the powder particles. Thus, in an embodiment, the particle can include a plurality of coating layers, wherein each of the plurality of coating layers can be the same or different composition. While it is contemplated that there is no upper limit to the number of coating layers (e.g., 72, 74, 76, 78) or hollow space 80, the number of coating layers can be from 1 to 50, specifically 1 to 10, and more specifically 1 to 3. Here, the ferrous alloy in the ferrous alloy particles (50, 54, 56, 60, 64, and the like) can be the same or different ferrous alloy. Also, the secondary element in secondary particles (52, 58, 62, and the like) and coating layers (72, 74, 76, 78) can be the same or different secondary element. These powder constituents can be selected and configured for compaction and sintering to provide the disintegrable powder compact 200 that is lightweight (i.e., having a relatively low density), high-strength, and selectably and controllably removable, e.g., by disintegration, from an article or environment (e.g., a downhole environment such as a borehole) in response to, e.g., contact with a fluid or change in an environmental property, including being selectably and controllably disintegrable (e.g., by having a selectively tailorable disintegration rate curve) in an appropriate disintegration fluid, including various borehole fluids as disclosed herein.

In an embodiment, for a primary particle 252 that has a coating (e.g., 72, 74, 76, 78) and that forms the dispersed particles 214 in the disintegrable powder compact 200, the coating layer can remain disposed on and intact on the primary particle 252. In another embodiment, for a secondary particle 254 that has a coating (e.g., 72, 74, 76, 78) of the secondary element and that forms the dispersed particles 214 in the disintegrable powder compact 200, the coating layer can remain disposed on and intact on the secondary particle 254. Moreover, the matrix 216 and coating (72, 74, 76, 78) of the secondary element have different standard electrode potentials. In an embodiment, the coating (72, 74, 76, 78) of the secondary element and particle core material 218 (e.g., ferrous alloy particle core material 66 or secondary element particle core materials 68, 70) are different from each other. In some embodiments, the coating (72, 74, 76, 78) completely surrounds the particle core material (66, 68, 70) and blocks contact between the particle core material (66, 68, 70) and the matrix 216.

According to an embodiment, the ferrous alloy particles and secondary particles are combined and processed to form the disintegrable powder compact. The ferrous alloy can be present in an amount from 5 wt % to 95 wt %, specifically 50 wt % to 95 wt %, and more specifically 65 wt % to 95 wt %, based on a weight of the disintegrable powder compact. The secondary element can be present in an amount from 5 wt % to 95 wt %, specifically 5 wt % to 50 wt %, and more specifically 5 wt % to 35 wt %, based on the weight of the disintegrable powder compact. Further, the disintegrable powder compact is configured to disintegrate in response to contact with a disintegration fluid.

The nanostructure 215 shown in FIGS. 1 and 2 can be formed in the primary particle 252 or secondary particle 254 (that is used to form dispersed particle 214) by any suitable method, including a deformation-induced nanostructure such as can be provided by ball milling a powder to provide the primary particle 252 or secondary particle 254, and more particularly by cryomilling (e.g., ball milling in ball milling media at a cryogenic temperature or in a cryogenic fluid, such as liquid nitrogen) a powder to provide the particles (252, 254) used to form the dispersed particle 214. The particles (252, 254) may be formed as a nanostructured material 215 by any suitable method, such as, for example, by milling or cryomilling of prealloyed powder particles of the materials described herein. The particles (252, 254) can also be formed by mechanical alloying of pure (e.g., metal) powders of the desired amounts of the various alloy or elemental constituents. Mechanical alloying involves ball milling, including cryomilling, of these powder constituents to mechanically enfold and intermix the constituents and form particles (252, 254). In addition to the creation of nanostructure as described above, ball milling, including cryomilling, can contribute to solid solution strengthening of the particles (252, 254) and core material therein, which in turn can contribute to solid solution strengthening of the dispersed particle 214 and particle core material 218. The solid solution strengthening can result from the ability to mechanically intermix a higher concentration of interstitial or substitutional solute atoms in the solid solution than is possible in accordance with the particular alloy constituent phase equilibria, thereby providing an obstacle to, or serving to restrict, the movement of dislocations within the particle, which in turn provides a strengthening mechanism in the particles (252, 254) and the dispersed particle 214. The particles (252, 254) can also be formed with a nanostructure (grain boundaries 227, 229) by methods including inert gas condensation, chemical vapor condensation, pulse electron deposition, plasma synthesis, crystallization of amorphous solids, electrodeposition, and severe plastic deformation, for example. The nanostructure also can include a high dislocation density, such as, for example, a dislocation density from $10^{17}$ $m^{-2}$ to $10^{18}$ $m^{-2}$, which can be two to three orders of magnitude higher than similar alloy materials deformed by traditional methods, such as cold rolling. Thus, the particles (252, 254) can be formed without a coating or surrounded by metallic coating layer (as in FIG. 4, particles 54, 56, 58, 60, 62, or 64) in a powder process that can include cyromilling, ball milling, and the like. Further, non-mechanical processes such as a chemical vapor deposition can be used to deposit coating layer (72, 74, 76, or 78) on particle core material 66, 68, 70, for example. Here, it should be appreciated that individual particles (252, 254) can be coated independently from one another and can separately receive a coating layer (not shown in FIG. 3).

The substantially-continuous matrix 216 (see FIGS. 1 and 3) and matrix material 220 is formed from one of primary particles 252 or secondary particles 254 by the compaction and sintering of powder particles (252, 254), such as by cold isostatic pressing (CIP), hot isostatic pressing (HIP), dynamic forging, die forging, extrusion, injection molding, and the like. Moreover, the dispersed particles 214 and particle core material 218 correspond to and are formed from one of the primary or secondary particles (252 or 254), whichever does not form the matrix. Without wishing to be bound by theory, whether the primary particles 252 or secondary particles 254 form the matrix 216 can be due to the relative hardness of particles (252, 254), the relative amount of each type of particle (252, 254), or similar factors. It is contemplated that if the primary particles 252 form the matrix 216, then the secondary particles 254 form the dispersed particles 214 in the disintegrable powder compact 200. In an embodiment, the secondary particles 254 form the matrix 216, and the primary particles 252 form the dispersed particles 214 in the disintegrable powder compact 200.

The use of the term substantially continuous matrix is intended to describe the extensive, regular, continuous, and interconnected nature of the distribution of matrix material 220 within the disintegrable powder compact 200. As used herein, "substantially continuous" describes the extension of the matrix material 220 throughout the disintegrable powder compact 200 such that it extends between and envelopes substantially all of the dispersed particle 214. Substantially continuous is used to indicate that complete continuity and regular order of the matrix 216 around individual particles of the dispersed particles 214 are not required. For example, some primary particles 252 that form the dispersed particles 214 may become bridged during sintering of the disintegrable powder compact 200, thereby causing localized discontinuities to result within the matrix 216, even though in the other portions of the disintegrable powder compact 200 the matrix 216 is substantially continuous and exhibits the structure described herein. Since the matrix 216 generally comprises the interdiffusion and bonding of identical particles (either primary particles 252 or secondary particles 254) of adjacent powder particles, the matrix 216 formed has a local thickness (i.e., between dispersed particles 214) of approximately the sum of the diameters of the particles that combine to form the matrix 216 between the dispersed particles 214. Depending on the relative amounts of the primary particles 252 and secondary particles 254, the distance between dispersed particles 214 in the matrix 216 of the ferrous disintegrable powder compact can vary and can be greater than the sum of the diameters of two particles that combine to form the matrix 216 (e.g., the sum of diameters of 3 particles and greater) up to many times greater than this distance. In some embodiments, the distance between dispersed particles 214 is on the micron scale, instead of on the nanometer scale. That is, adjacent dispersed particles 214 can be separated by one micrometer or greater due to the amount of matrix 216 therebetween. An average distance between dispersed particles 214 in the matrix 216 can be greater than or equal to 1 μm, specifically from 1 μm to 250 μm, more specifically 1 μm to 125 μm, and yet more specifically 1 μm to 75 μm. The use of the term dispersed particle is intended to convey the discontinuous and discrete distribution of particle core material 218 within disintegrable powder compact 200. The distribution of individual particle core material 218 may or may not form a repeated pattern in the disintegrable powder compact 200.

Embedded particle 224 can be embedded by any suitable method, including, for example, by ball milling or cryomilling hard particles together with the primary or secondary particles (252, 254). A precipitate particle 226 can include any particle that can be precipitated within the dispersed particles 214, including precipitate particles 226 consistent with the phase equilibria of constituents of the materials, particularly metal alloys, of interest and their relative amounts (e.g., a precipitation hardenable alloy), and including those that can be precipitated due to non-equilibrium conditions, such as may occur when an alloy constituent that has been forced into a solid solution of the alloy in an amount above its phase equilibrium limit, as is known to occur during mechanical alloying, is heated sufficiently to activate diffusion mechanisms that enable precipitation. Dispersoid particles 228 can include nanoscale particles or clusters of elements resulting from the manufacture of the primary or secondary particles (252, 254), such as those associated with ball milling, including constituents of the milling media (e.g., balls) or the milling fluid (e.g., liquid nitrogen) or the surfaces of the primary or secondary particles (252, 254) themselves (e.g., metallic oxides or nitrides). Dispersoid particles 228 can include an element such as, for example, Ca, Si, Mo, Fe, Ni, Cr, Mn, N, O, C, H, and the like. The additive particles 222 can be disposed anywhere in conjunction with primary or secondary particles (252, 254) and the dispersed particles 214. In an exemplary embodiment, additive particles 222 can be disposed within or on the surface of dispersed particles 214 as illustrated in FIG. 1. In another exemplary embodiment, a plurality of additive particles 222 are disposed on the surface of the dispersed particle 214 and also can be disposed in the matrix 216 as illustrated in FIG. 1.

In an embodiment, the disintegrable powder compact optionally includes a strengthening agent. The strengthening agent increases the material strength of the disintegrable powder compact. Exemplary strengthening agents include a ceramic, polymer, metal, nanoparticles, cermet, and the like. In particular, the strengthening agent can be silica, glass fiber, carbon fiber, carbon black, carbon nanotubes, oxides, carbides, nitrides, silicides, borides, phosphides, sulfides, cobalt, nickel, iron, tungsten, molybdenum, tantalum, titanium, chromium, niobium, boron, zirconium, vanadium, silicon, palladium, hafnium, aluminum, copper, or a combination thereof. According to an embodiment, a ceramic and metal is combined to form a cermet, e.g., tungsten carbide, cobalt nitride, and the like. Exemplary strengthening agents particularly include magnesia, mullite, thoria, beryllia, urania, spinels, zirconium oxide, bismuth oxide, aluminum oxide, magnesium oxide, silica, barium titanate, cordierite, boron nitride, tungsten carbide, tantalum carbide, titanium carbide, niobium carbide, zirconium carbide, boron carbide, hafnium carbide, silicon carbide, niobium boron carbide, aluminum nitride, titanium nitride, zirconium nitride, tantalum nitride, hafnium nitride, niobium nitride, boron nitride, silicon nitride, titanium boride, chromium boride, zirconium boride, tantalum boride, molybdenum boride, tungsten boride, cerium sulfide, titanium sulfide, magnesium sulfide, zirconium sulfide, or a combination thereof.

In one embodiment, the strengthening agent is a particle with size from 100 μm or less, specifically 10 μm or less, and more specifically 500 nm or less. In another embodiment, a fibrous strengthening agent can be combined with a particulate strengthening agent. It is believed that incorporation of the strengthening agent can increase the strength and fracture toughness of the disintegrable powder compact. Without wishing to be bound by theory, finer (i.e., smaller) sized particles can produce a stronger disintegrable powder compact as compared with larger sized particles. Moreover, the shape of the strengthening agent can vary and includes fiber, sphere, rod, tube, and the like. The strengthening agent can be present in an amount of 0.01 wt % to 20 wt %, specifically 0.01 wt % to 10 wt %, and more specifically 0.01 wt % to 5 wt %.

In a process for preparing a disintegrable powder compact or article thereof (e.g., a slip, pressure plug, frac plug, and the like), the process includes combining a primary particle including a ferrous alloy that comprises carbon with a secondary particle to form a composition; compacting the composition to form a preform; and sintering the preform to form the disintegrable powder compact by forming a matrix from one of the primary particle or the secondary particle and forming a plurality of dispersed particles from the other of the primary particle or the secondary particle. Sintering can be accompanied with or followed by pressing the material to form the disintegrable powder compact or article thereof.

The members of the composition can be mixed, milled, blended, and the like to form the powder 10 as shown in FIG. 2 for example. It should be appreciated that the metal matrix material is one of the primary particles or secondary particles that, when compacted and sintered, forms the matrix, while the other of the primary particles or secondary particles forms the dispersed particles dispersed in the matrix. A compact can be formed by pressing (i.e., compacting) the composition at a pressure to form a green compact. The green compact can be subsequently pressed under a pressure from 15,000 psi to 100,000 psi, specifically 20,000 psi to 80,000 psi, and more specifically 30,000 psi to 70,000 psi, at a temperature from 250° C. to 600° C., and specifically 300° C. to 450° C., to form the powder compact. Pressing to form the powder compact can include compression in a mold. The powder compact can be further machined to shape the powder compact to a useful shape. Alternatively, the powder compact can be pressed into the useful shape. Machining can include cutting, sawing, ablating, milling, facing, turning, lathing, polishing, boring, bending, and the like using, for example, a mill, table saw, lathe, router, drill, brake, lapping table, electric discharge machine, and the like. Furthermore, a plurality of pieces of disintegrable powder compact material can be joined together, e.g., by welding or fastening, to form the disintegrable powder compact or article thereof. The disintegrable powder compact is configured to disintegrate in response to contact with a disintegration fluid or a changed environmental condition (e.g., temperature, pressure, pH, time, and the like). In an embodiment, the primary particles and secondary particles have different standard electrode potentials, the dissimilarity (e.g., absolute difference) of which can mediate the rate of disintegration of the disintegrable powder compact.

In an embodiment, the method further includes coating the primary particle or secondary particle with an element comprising aluminum, calcium, cobalt, copper, iron, magnesium, manganese, molybdenum, nickel, silicon, zinc, a rare earth element, or a combination thereof prior to combining the primary particle and the secondary particle. The disintegrable powder compact 200 can have any desired shape or size, including that of a cylindrical billet, bar, sheet, toroid, or other form that may be machined, formed or otherwise used to form useful articles of manufacture, including various wellbore tools and components. Pressing is used to form the disintegrable powder compact or article thereof (e.g., a slip, frac plug, pressure plug, and the like) from the sintering and pressing processes used to form the disintegrable powder compact 200 by deforming the primary particles 252 and secondary particles 254 to provide the full density and desired macroscopic shape and size of the disintegrable powder compact 200 as well as its microstructure. The morphology (e.g., a spherical or spheroidal shape) of the individual dispersed particles 214 in the matrix 216 results from sintering and deformation of the powder particles, i.e., the primary or secondary particles (252, 254), as they are compacted, interdiffuse, and deform to fill the interparticle spaces in the forming disintegrable powder compact 200 (FIG. 1). The sintering temperatures and pressures can be selected to ensure that the density of the disintegrable powder compact 200 achieves substantially full theoretical density.

According to an embodiment, the method additionally includes treating a surface of the disintegrable powder compact or article thereof. Treating the surface can include various heat, chemical, physical, or irradiation treatments that modify the surface of the disintegrable powder compact and can improve properties such as hardness, chemical compatibility, ductility, disintegraton resistance, disintegration enhancement, and the like. All of the surface of the disintegrable powder compact or only a portion of the total surface of the disintegrable powder compact can be treated. Exemplary treatments include carburizing, nitriding, carbonitriding, boriding, flame hardening, induction hardening, laser beam hardening, electron beam hardening, hard chromium plating, electroless nickel plating, thermal spraying, weld hardfacing, ion implantation, or a combination thereof. As a consequence of treating the surface, the disintegrable powder compact includes a surface hardened product of the matrix and dispersed particles formed in response to subjecting the disintegrable powder compact to the surface treatment, e.g., carburizing, nitriding, carbonitriding, boriding, flame hardening, induction hardening, laser beam hardening, electron beam hardening, hard chromium plating, electroless nickel plating, thermal spraying, weld hardfacing, ion implantation, or a combination thereof. The surface hardened product can include, e.g., formation of a covalent bond (single or multiple bond), dangling bond (e.g., a lone electron pair), carbon-nitrogen species, carbon-boron species, carbon-oxygen species, carbon-chromium species, iron-nitrogen species, iron-carbon species, iron-oxygen species, iron-boron species, iron chromium species, a crystalline facet, a reactive site, a passivation layer, and the like.

The disintegrable ferrous compact can be made using liquid phase sintering, injection molding, casting, or a combination thereof. According to an embodiment, a process for making the compact includes combining a primary particle including a ferrous alloy that comprises carbon with a secondary particle to form a composition; and subjecting the composition to liquid phase sintering, injection molding, casting, or a combination thereof. The temperature and pressure can be the same as the temperature used for powder metallurgy involving compacting and sintering described above. In an embodiment, the temperature that is used during, e.g., can be less than, equal to, or greater than the melting temperature of the secondary particles but less than the melting temperature of the primary particles that include a ferrous alloy comprising carbon. In some embodiments, the temperature is equal to or greater than the melting temperature of the secondary particles and less than the melting temperature of the primary particles. In this manner, the secondary particles melt such that they can form a binder to bind the primary particles together.

The disintegrable powder compact has beneficial properties for use in, for example, a downhole environment such as that encountered in a subterranean borehole, frac vein, reservoir, and the like. In an embodiment, a disintegrable article made of the disintegrable powder compact has an initial shape that can be run downhole or, before being disposed in a downhole location, manipulated, e.g., by bending, elongating (such as by stretching), cutting, or drilling to be formed into an appropriate shape, which can be run downhole. The disintegrable powder compact is strong and ductile with a percent elongation from 0.1% to 75%, specifically 5% to 75%, and more specifically 5% to 40%, based on the original size of the disintegrable powder compact. The disintegrable powder compact has a hardness from 20 to 65, and specifically 25 to 60, based on Rockwall hardness scale C. The density of the disintegrable powder compact herein is from 1.5 grams per cubic centimeter ($g/cm^3$) to 8.5 $g/cm^3$, and specifically 2.0 $g/cm^3$ to 8.0 $g/cm^3$. The disintegrable powder compact has a compressive strength from 15 kilopounds per square inch (ksi) to 150 ksi, and specifically 30 ksi to 150 ksi. The yield strength of the disintegrable powder compact is from 30 ksi to 100 ksi, and specifically 40 ksi to 80 ksi. To deform the disintegrable powder compact a setting pressure of up to about 10,000 psi, and specifically about 9,000 psi can be used. In an embodiment, an article can have a plurality of components made of the disintegrable powder compact. Such components of the disintegrable article can have the same or different material properties, such as percent elongation, compressive strength, tensile strength, and the like. Moreover, as the amount of the ferrous alloy comprising carbon increases in the disintegrable powder compact, the modulus of elasticity or hardness also increases. In an embodiment, as the amount of the ferrous alloy comprising carbon increases from 50 wt % to 90 wt % (based on the weight of the disintegrable powder compact), the modulus of elasticity increases from 55 gigapascals (GPa) to 130 GPa.

Thus, in an embodiment, the disintegrable powder compact (and an article thereof) have a percent elongation at failure greater than 5%, specifically greater than 30%, more specifically greater than 35%, based on the original size of the disintegrable implant; compressive strength 50 ksi to 150 ksi; or yield strength from 30 ksi to 100 ksi, and specifically 60 ksi to 80 ksi. In an embodiment, the article comprising the disintegrable powder compact can include multiple components that are combined or interwork, e.g., a slip and tubular. The components of the article can have the same or different material properties, such as percent elongation, compressive strength, tensile strength, and the like.

Unlike elastomeric materials, the disintegrable article herein that includes the disintegrable powder compact has a temperature rating up to 1200° F., specifically up to 1000° F., and more specifically 800° F., allowing high working temperatures for processing the implant. The disintegrable article is temporary in that the article is selectively and tailorably disintegrable in response to contact with a fluid, e.g., a downhole fluid, or change in condition (e.g., pH, temperature, pressure, time, and the like). Moreover, in an embodiment with multiple components of the disintegrable article, each component can have the same or different disintegration rate or reactivity with the fluid. Exemplary downhole fluids include brine, mineral acid, organic acid, or a combination comprising at least one of the foregoing. The brine can be, for example, seawater, produced water, completion brine, or a combination thereof. The properties of the brine can depend on the identity and components of the brine. Seawater, as an example, contains numerous constituents such as sulfate, bromine, and trace metals, beyond typical halide-containing salts. On the other hand, produced water can be water extracted from a production reservoir (e.g., hydrocarbon reservoir), produced from the ground. Produced water also is referred to as reservoir brine and often contains many components such as barium, strontium, and heavy metals. In addition to the naturally occurring brines (seawater and produced water), completion brine can be synthesized from fresh water by addition of various salts such as KCl, NaCl, $ZnCl_2$, $MgCl_2$, or $CaCl_2$ to increase the density of the brine, such as 10.6 pounds per gallon of $CaCl_2$ brine. Completion brines typically provide a hydrostatic pressure optimized to counter the reservoir pressures downhole. The above brines can be modified to include an additional salt. In an embodiment, the additional salt included in the brine is NaCl, KCl, NaBr, $MgCl_2$, $CaCl_2$, $CaBr_2$, $ZnBr_2$, $NH_4Cl$, sodium formate, cesium formate, and the like. The salt can be present in the brine in an amount from about 0.5 wt. % to about 50 wt. %, specifically about 1 wt. % to about 40 wt. %, and more specifically about 1 wt. % to about 25 wt. %, based on the weight of the composition.

In another embodiment, the downhole fluid is a mineral acid that can include hydrochloric acid, nitric acid, phosphoric acid, sulfuric acid, boric acid, hydrofluoric acid, hydrobromic acid, perchloric acid, or a combination comprising at least one of the foregoing. In yet another embodiment, the downhole fluid is an organic acid that can include a carboxylic acid, sulfonic acid, or a combination comprising at least one of the foregoing. Exemplary carboxylic acids include formic acid, acetic acid, chloroacetic acid, dichloroacetic acid, trichloroacetic acid, trifluoroacetic acid, proprionic acid, butyric acid, oxalic acid, benzoic acid, phthalic acid (including ortho-, meta- and para-isomers), and the like. Exemplary sulfonic acids include alkyl sulfonic acid or aryl sulfonic acid. Alkyl sulfonic acids include, e.g., methane sulfonic acid. Aryl sulfonic acids include, e.g., benzene sulfonic acid or toluene sulfonic acid. In one embodiment, the alkyl group may be branched or unbranched and may contain from one to about 20 carbon atoms and can be substituted or unsubstituted. The aryl group can be alkyl-substituted, i.e., may be an alkylaryl group, or may be attached to the sulfonic acid moiety via an alkylene group (i.e., an arylalkyl group). In an embodiment, the aryl group may be substituted with a heteroatom. The aryl group can have from about 3 carbon atoms to about 20 carbon atoms and include a polycyclic ring structure.

According to an embodiment, the fluid includes halogen ions (e.g., chloride, bromide, iodide, and the like), mineral oxides (e.g., phosphate, sulfate, nitrate, and the like), organic oxides (acetate, formate, carboxylate, and the like), acids (e.g., Bronsted acid, Lewis acid, acetic acid, pyruvic acid, uric acid, hydrochloric acid, protons, hydronium, and the like), bases (Bronsted base, Lewis base, hydroxide, ammonia, urea, and the like), or a combination thereof. The properties of the fluid can depend on the identity and components of the fluid, and the chemical or physical properties of the fluid can be selected depending on the article in order to cause disintegration of the article over a desirable time period or operating condition of the downhole environment. It is contemplated that such fluid includes brine or another fluid that can include an agent that causes disintegration of the disintegrable article herein, e.g., an agent that is a source of halogen ions or mineral oxides, and the like. In an embodiment, the fluid includes various salts such as KCl, NaCl, $ZnCl_2$, $MgCl_2$, $CaCl_2$, NaBr, $CaBr_2$, $ZnBr_2$, $NH_4Cl$, sodium formate, cesium formate, and the like. The salt can be present in the fluid in an amount from 0.2 wt. % to 50 wt. %, specifically 0.5 wt. % to 30 wt. %, and more specifically 1 wt. % to 25 wt. %, based on the weight of the composition. Moreover, the fluid can be naturally occurring or synthetic, circulating or non-circulating, or a combination thereof.

The disintegration rate (also referred to as rate of corrosion) of the disintegrable powder compact is 0 milligram per square centimeter per hour ($mg/cm^2/hr$) to 200 $mg/cm^2/hr$, specifically 10 $mg/cm^2/hr$ to 200 $mg/cm^2/hr$, and more specifically 50 $mg/cm^2/hr$ to 200 $mg/cm^2/hr$. The disintegration rate is variable upon the composition, difference in standard electrode potentials of the matrix and dispersed particles (e.g., in no particular order, the secondary element and the ferrous alloy comprising carbon), and processing conditions used to form the disintegrable powder compact herein. Particularly, the disintegration rate is determined by the microstructure of the disintegrable powder compact having the dispersed particles (with or without a coating layer) surrounded by and in contact with the matrix. It should be appreciated that ordinary metal alloys fail to possess the control over disintegration provided by the electrochemical interfaces between the dispersed particles and the matrix and microstructure of the disintegrable powder compact herein.

Figure 5:
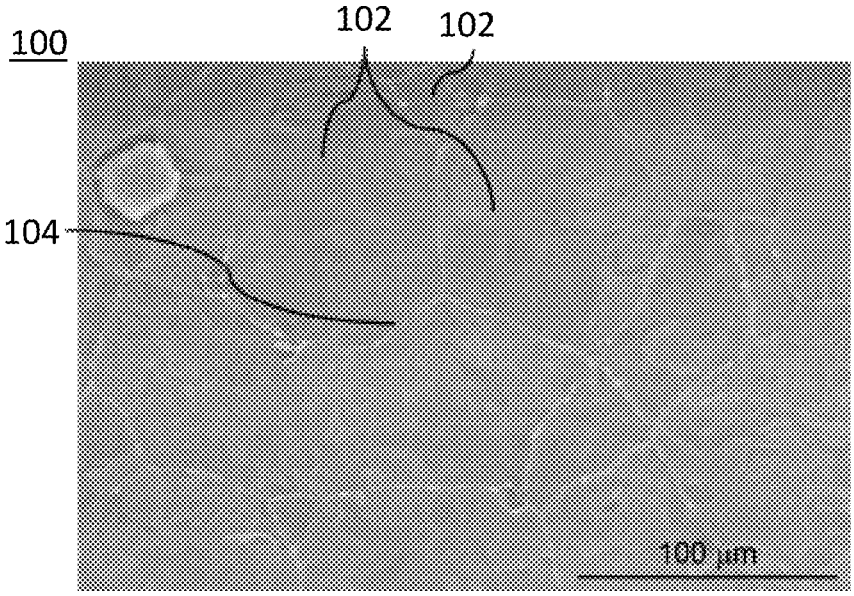
FIG. 5 is a photomicrograph of a pure metal without a particles dispersed in a matrix.
Figure 6:
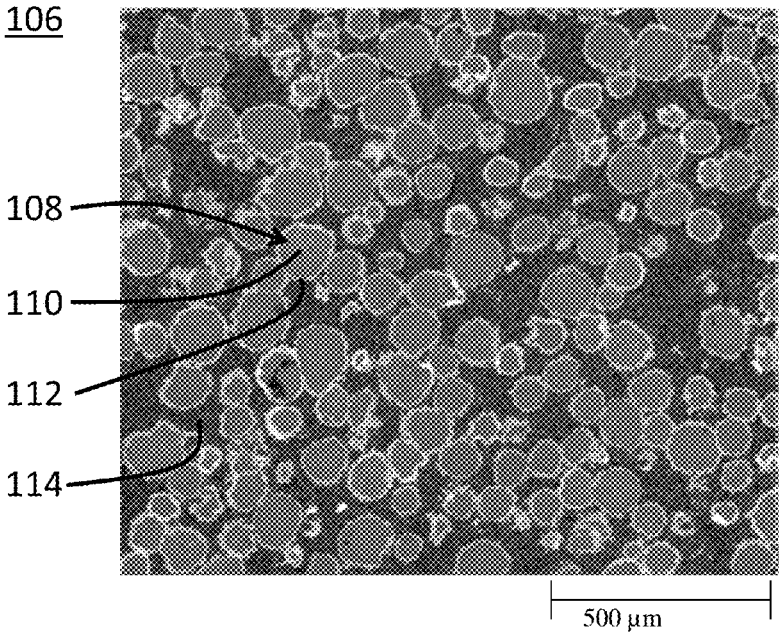
FIG. 6 is a photomicrograph of a powder compact according to an embodiment herein.

Without wishing to be bound by theory, the unexpectedly controllable disintegration rate of the disintegrable powder compact herein is due to the microstructure that provides the electrochemical interface between the dispersed particles and the matrix. As discussed above, such microstructure is provided by using powder metallurgical processing (e.g., compaction and sintering) of powders of primary and secondary particles, wherein one of primary or secondary particles produces the matrix, and the other of primary or secondary particles produces the particle core material of the dispersed particles. It is believed that the intimate proximity of the matrix to the particle core material of the dispersed particles in the disintegrable powder compact produces galvanic sites for rapid and tailorable disintegration of the dispersed particles and matrix. Such electrolytic sites occur at electrochemical interfaces between the dispersed particles and the matrix that are missing in single metals or alloys that lack a matrix and dispersed particles having different standard electrode potentials. For illustration, FIG. 5 shows a compact 100 formed from magnesium powder. Although the compact 100 exhibits particles 102 surrounded by particle boundaries 104, the particle boundaries constitute physical boundaries between substantially identical material (particles 102), but the particle boundaries 104 and particles 102 do not have an electrochemical activity difference (i.e., different standard electrode potentials that give rise to an electrochemical interface therebetween) that controls the disintegration rate of the compact 100. Merely, the particle boundaries 104 represent points of direct contact between adjacent particles 102. However, FIG. 6 shows a photomicrograph of an exemplary embodiment of a disintegrable powder compact 106 that includes a dispersed particles 108 having particle core material 110 and coating layer 112 disposed in a matrix 114. The disintegrable powder compact 106 was prepared by forming dispersed particles 108 from primary particles of nickel coated ferrous alloy particle core material and secondary particles of a magnesium alloy. Under powder metallurgical processing, the secondary particles produce the matrix 114 of the magnesium alloy, and the primary particles form the dispersed particles 108 having a nickel coating layer 112 and ferrous alloy particle core material 110. Matrix 114 is not just a physical boundary as the particle boundary 104 in FIG. 5 but is also a chemical boundary interposed between neighboring particle core materials 110 of the dispersed particles 108. Whereas the particles 102 and particle boundary 104 in compact 100 (FIG. 5) do not have galvanic sites, dispersed particles 108 having particle core material 110 establish a plurality of galvanic sites in conjunction with the matrix 114 because the particle core material 110 of the dispersed particles 108 have a different standard electrode potential (i.e., electrochemical activity) than the matrix 114. The reactivity of the galvanic sites depends on the compounds used in the dispersed particle 108, the coating layer 112 (when present), and the matrix 114. The microstructure of the disintegrable powder compact 106 is an outcome of the processing conditions used to form the dispersed particles 108 and matrix 114 of the disintegrable powder compact 106.

Figure 7:
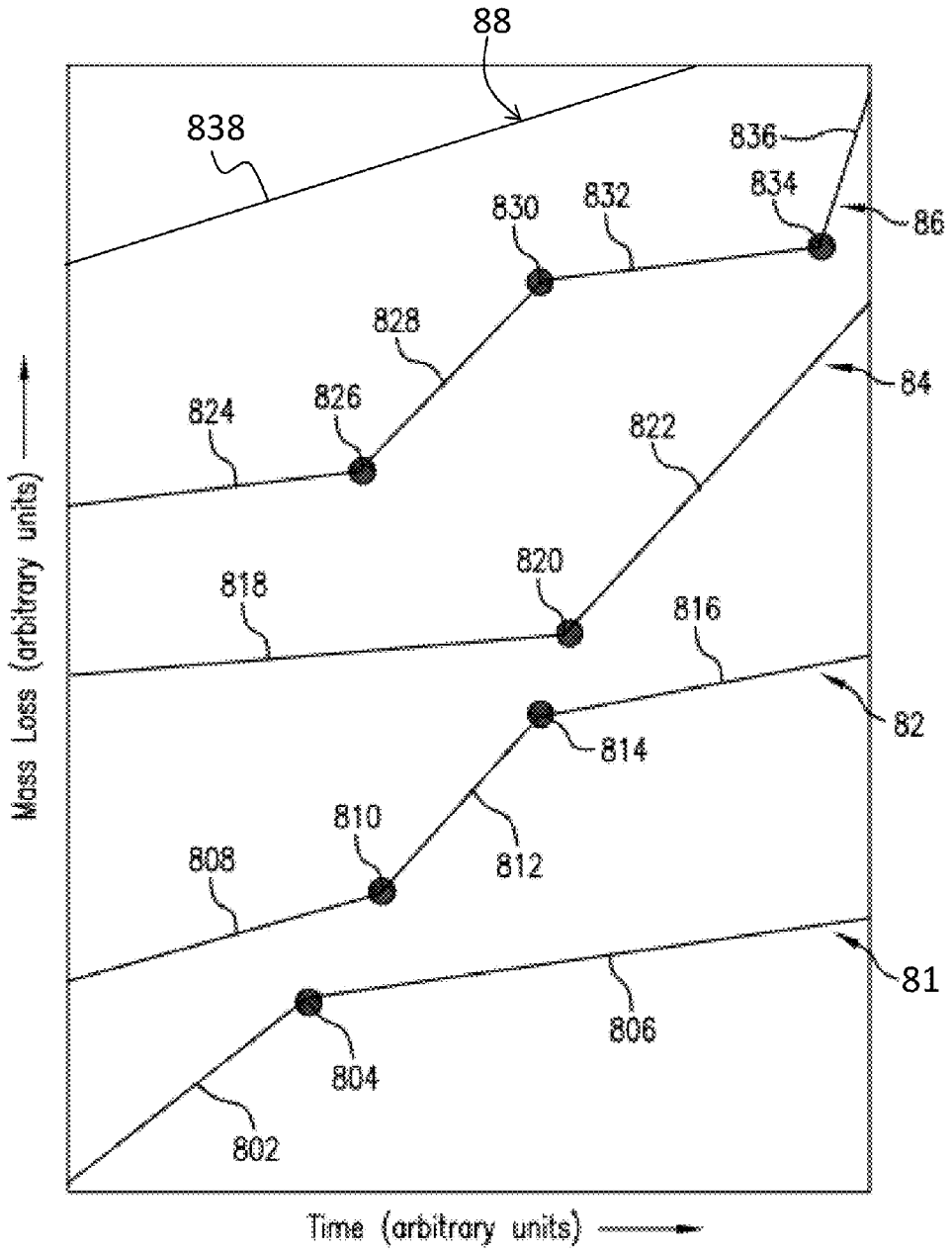
FIG. 7 is a graph of mass loss versus time for various disintegrable powder compacts that include dispersed particles in a matrix indicating selectively tailorable disintegration rates.

Moreover, the microstructure of the disintegrable powder compact herein is controllable by selection of powder metallurgical processing conditions and chemical materials used in the powders and coatings. Therefore, the disintegration rate is selectively tailorable as illustrated for disintegrable powder compacts of various compositions in FIG. 7, which shows a graph of mass loss versus time for various disintegrable powder compacts that include dispersed particles in a matrix. Specifically, FIG. 7 displays disintegration rate curves for five different disintegrable powder compacts (disintegrable powder compact A 81, disintegrable powder compact B 82 disintegrable powder compact C 84, disintegrable powder compact D 86, and disintegrable powder compact E 88). The slope of each segment of each curve (separated by the black dots in FIG. 7) provides the disintegration rate for particular segments of the curve. Disintegrable powder compact A 81 has two distinct disintegration rates (802, 806). Disintegrable powder compact B 82 has three distinct disintegration rates (808, 812, 816). Disintegrable powder compact C 84 has two distinct disintegration rates (818, 822), and disintegrable powder compact D 86 has four distinct disintegration rates (824, 828, 832, and 836). At a time represented by points 804, 810, 814, 820, 826, 830, and 834, the rate of the disintegration of the disintegrable powder compact (80, 82, 84, 86) changes due to a changed condition (e.g., presence or absence of a fluid, change of an amount of the fluid, pH, temperature, time, pressure as discussed above). The rate may increase (e.g., going from rate 818 to rate 822) or decrease (e.g., going from rate 802 to 806) along the same disintegration curve. Moreover, a disintegration rate curve can have more than two rates, more than three rates, more than four rates, etc. based on the microstructure and components of the powder metallic compact. Further, the disintegration rate can be constant as illustrated by the linear mass loss of disintegrable powder compact E 88, having a single rate 838. In this manner, the disintegration rate curve is selectively tailorable and distinguishable from mere metal alloys and pure metals that lack the microstructure (i.e., dispersed particle in the matrix) of the disintegrable powder compacts described herein.

Not only does the microstructure of the disintegrable powder compact govern the disintegration rate behavior of the disintegrable powder compact but also affects the strength of the disintegrable powder compact. Consequently, the disintegrable powder compacts herein also have a selectively tailorable material strength yield (and other material properties), in which the material strength yield varies due to the processing conditions and the materials used to produce the disintegrable powder compact. The microstructural morphology of the substantially continuous, matrix (FIG. 6), which can be selected to provide a strengthening phase material, with the dispersed particles (having particle core material) provides the disintegrable powder compacts herein with enhanced mechanical properties, including compressive strength and sheer strength, since the resulting morphology of the matrix/dispersed particles can be manipulated to provide strengthening through the processes that are akin to traditional strengthening mechanisms, such as grain size reduction, solution hardening through the use of impurity atoms, precipitation or age hardening and strain/work hardening mechanisms. The matrix/dispersed particles structure tends to limit dislocation movement by virtue of the numerous particle nanomatrix interfaces, as well as interfaces between discrete layers within the matrix material as described herein. For a compact made using pure Mg powder (FIG. 5), a shear stress can induce failure by intergranular fracture. In contrast, the disintegrable powder compact of FIG. 6 made using powder particles having ferrous alloy particle cores to form dispersed particles and secondary particles of a secondary element (e.g., a Mg alloy) to form the matrix, when subjected to a shear stress sufficient to induce failure, can have transgranular fracture with a substantially higher fracture stress. Because these disintegrable powder compacts herein have high-strength characteristics, the primary particles and secondary particles can be selected to be low density materials or other low density materials, such as low-density metals, ceramics, glasses or carbon, that otherwise would not provide the necessary strength characteristics for use in the desired applications, including fully disintegrable powder compact and articles therefore.

Thus, the disintegrable powder compacts herein can be configured to provide a wide range of selectable and controllable corrosion or disintegration behavior from very low corrosion rates to extremely high disintegration rates, particularly disintegration rates that are both lower and higher than those of powder compacts that do not incorporate dispersed particles in a matrix, such as a compact formed from powder of a ferrous alloy comprising carbon through the same compaction and sintering processes in comparison to those that include such dispersed particles in the various matrices described herein. These disintegrable powder compacts also can be configured to provide substantially enhanced properties as compared to compacts formed from pure metal (e.g., pure Mg) particles that do not include the coating layers described herein. Moreover, metal alloys (formed by, e.g., casting from a melt or formed by metallurgically processing a powder) without the dispersed particles in the matrix also do not have the selectively tailorable material and chemical properties or microstructure as the disintegrable powder compacts herein.

As mentioned above, the disintegrable powder compact is used to produce disintegrable articles that can be used as tools or implements, e.g., in a downhole environment. The material strength of the disintegrable powder compact herein is greater than that of other pure metals and alloys already in use in some downhole tools, and articles of the disintegrable powder compact have a high strength to bulk ratio. As such, the article can be used for downhole tools that experience large tensile loading or that benefit from high hardness or high elongation. Furthermore, the article is completely or partially disintegrable in response to contact with a fluid and does not need mechanical intervention for disintegration or removal from a downhole location. Additionally, the disintegration is tailorable and can be greater or much greater than the rate of rusting of other materials in the presence of a wellbore fluid. Moreover, the high ductility of the disintegrable powder compact herein enables the article to be manipulated (such as bending or otherwise changed) by, e.g., an engineer, technician or machinist, so that the article attains a particular shape. In a particular embodiment, the article is a slip, frac plug, pressure plug, or other downhole tool with a large hardness, ductility, and yield strength and tailorable disintegration rate, or a disintegrable powder compact microstructure herein. In another embodiment, a plurality of articles can be used alone or in combination as a disintegrable system.

According to an embodiment, the article of the disintegrable powder compact can be removed non-mechanically from a location, e.g., a borehole or frac vein. The disintegration of disintegrable powder compacts by non-mechanical disintegration can be accomplished by contact with a fluid, which initiates an electrochemical reaction or other disintegration mechanism. Such disintegration of the article can include departure or removal of metal or other constituent of the disintegrable powder compact. Such disintegration reduces the mass of the disintegrable powder compact or number density of the constituents of the disintegrable powder compact.

According to an embodiment, a disintegrable article includes the disintegrable powder compact having dispersed particles in the matrix and including a secondary element and a ferrous alloy comprising carbon such that the article is configured to disintegrate in response to contact with the fluid. In an embodiment, the article includes a plurality of components, and each component is made of a disintegrable powder compact and has a same or different disintegration rate. In one embodiment, the plurality of components includes a first component and a second component attached to or interworking with the first component. It is contemplated that each component of the article is made of the disintegrable powder compact and removable non-mechanically from a downhole environment such as by disintegration in response to contact with a fluid. It should be appreciated that the disintegration rates of the components of the article are independently selectively tailorable as discussed above, and that the components of the article can have independently selectively tailorable material properties such as yield strength, compressive strength, and disintegration rate.

The disintegrable implant can have any shape. Exemplary shapes include a rod, pin, screw, plane, cone, frustocone, ellipsoid, spheroid, toroid, sphere, cylinder, their truncated shapes, asymmetrical shapes, including a combination of the foregoing, and the like.

In addition to being selectively corrodible, the article herein can deform in situ, e.g., to conform to a space in which it is disposed or other shape. The shape can be due to pressure exerted onto the article before or after disposal in a location. Further, the pressure can occur in situ by, e.g., hydraulic pressure, or by, e.g., machining or other process. According to an embodiment, the article maintains an original shape, i.e., the shape of the article prior to disposal in the location, such as being run downhole. Deformation of the article can occur in any direction, e.g., a radial direction, a length direction, and the like. The deformation can include stretching, compressing, twisting, and the like. Thus, the article can be a temporary article with an initial shape that can be disposed and subsequently deformed under pressure or can be deformed prior to disposal. Alternatively, due to the strength of the article, the article can be used to deform or modify the shape of another item that the article contacts. In an embodiment, the article is a disintegrable slip that bites into a casing and can deform a wall of the casing in order to set a downhole element, e.g., a packer, tubular, and the like.

Figure 8:
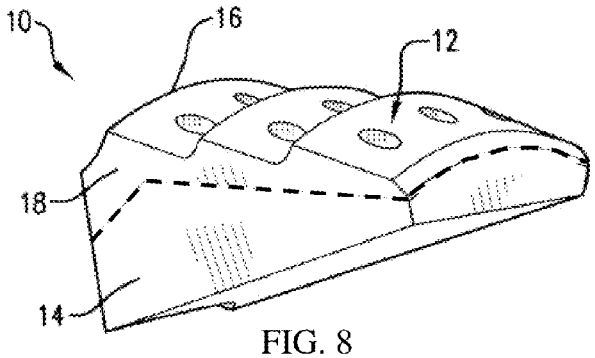
FIG. 8 is a perspective view of a slip element according to an embodiment herein.

One embodiment of a slip element 10 is shown in FIG. 8. The slip element 10 includes an outer surface 12 on a substrate 14. A plurality of teeth 16 are formed at the outer surface 12. The teeth 16 extend from the slip element 10 to bite into a wall of a tubular, such as a well casing, for enabling the slip element 10 to anchor a string, tool, downhole component, etc., in place. For example, the element or an assembly in which the element is installed (see, e.g., FIG. 9) can be wedge-shaped for engaging with a tubular wall in response to a load applied to the slip element 10 or assembly.

In this embodiment, the substrate 14 is made from the disintegrable powder compact herein that is disintegrable upon exposure to a fluid. The outer surface 12 can include a surface hardened material provided by surface treating the substrate 14. The slip is controllably disintegrable and has good strength and toughness in comparison to other degradable materials.

In some embodiments, the outer surface 12 can include a coating that is the same or different as the disintegrable powder compact of the substrate 14. Such coating can be a different disintegrable material than the substrate 14, a nondisintegrable material, a composite or composition including a nondisintegrable material and the disintegrable material of the substrate 14 or some other disintegrable material, etc.

In an embodiment, the outer surface 12 is a product of surface hardening the substrate 14, a graded layer 18 can present between the outer surface 12 and the substrate 14. The graded layer 18 can be, e.g., a functionally graded surface hardened layer transitioning from the disintegrable powder compact material of the substrate 14 to the surface hardened disintegrable powder compact material at the outer surface 12.

The ability of the slip element 10 to anchor other components is at least partially dependent on the hardness of the outer surface 12 (i.e., the ability of the teeth 16 to bite into a tubular). Thus, performance of the slip element 10 can be improved by selecting a material for the disintegrable powder compact of the substrate 14 that has a hardness suitable for biting into a tubular wall (typically a steel casing), that can disintegrated. Additionally, when present, the surface hardened product of the disintegrable powder compact in functionally graded layer 18 further can increase the strength of the slip element 10 to provide enhanced biting or other physical engagement with the tubular wall.

According to an embodiment, the slip element 10 can be arranged to disintegrate relatively slowly by selecting a disintegrable powder compact with a slow disintegration rate. Similarly, the slip element 10 can be arranged to disintegrate relatively rapidly by selecting a disintegrable powder compact with a high disintegration rate. Exposure to the proper downhole fluid can thus be made to have little, no, or great initial impact on the functioning of the slip element 10. In embodiments including the functionally graded layer 18 (e.g., a surfaced hardened disintegrable powder compact layer), the rate of degradation can also be set to increase as the percentage of the surface hardened material decreases or the composition of the material changes in or proximate to the substrate 14. In this way, the graded layer 18 can be used as a time-delay mechanism or disintegration rate variable for decreasing or increasing degradation of the slip element 10. That is, exposure of the slip element 10 to a downhole fluid can result in significant degradation of the slip element 10 after some predetermined amount of time or, alternatively, can significantly increase the initial rate of disintegration. For this reason, it may be advantageous in some embodiments to include a relatively thick graded layer 18 to accommodate a variable rate of disintegration of the slip element 10.

Figure 9:
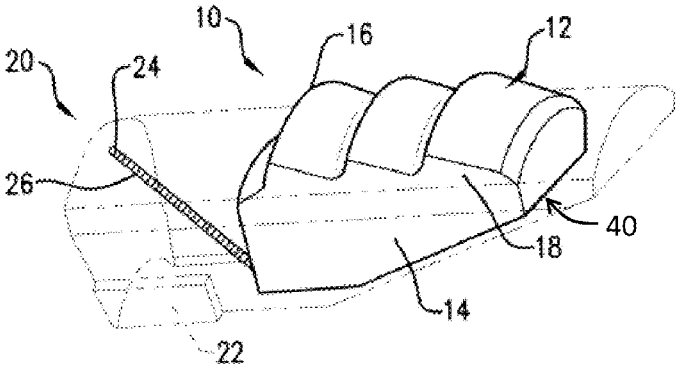
FIG. 9 is a perspective view of a slip assembly including the slip element of FIG. 8 disposed on a molding.

In the embodiment of FIG. 9, a slip assembly 20 includes the slip element 10 disposed in a molding 22, which is shown as partially transparent. The molding 22 is included to assist in installation of the slip element 10 in a downhole assembly. The assembly 20 is installable in any suitable system, for example, as described in U.S. Pat. No. 6,167,963 (McMahan et al.), which patent is hereby incorporated by reference in its entirety. Furthermore, the slip assembly 20 is usable for purposes other than a bridge plug as described in McMahan et al., such as for a packer, whipstock, or any other component that needs to be anchored in a borehole. Additionally, the molding 22 could be a fiberglass reinforced phenolic material as disclosed in McMahan et al., or any other suitable material, including the disintegrable powder compact herein.

The molding 22 could be broken, cracked, or removed, for example, by a drilling or milling operation in order to expose the substrate 14 to the fluid from the surface 40 of the slip element 10 opposing surface 12. Especially if the molding 22 is made from a disintegrable powder compact, it will be relatively easy to remove by disintegration in response to contact with a downhole fluid. If the molding 22 is made of phenolic material, it can be removed by milling. Such a drilling, milling, or fluid disintegration operation could be initiated to break, crack, or remove the molding 22 or a portion thereof, paused to enable the downhole fluids to degrade the substrate 14, and recommenced to remove any remaining material. Alternatively, the milling or drilling operation could be commenced simultaneously with the degradation of the slip element 10, with any portion, e.g., a chunk, of the slip element 10 that remains downhole continuing to disintegrate so that it does not have to be fished out. In other embodiments, the molding 22 can have a passage that is openable upon actuation of a sleeve or other valve mechanism to trigger disintegration of the slip element 10.

Also illustrated in FIG. 9, a fluid channel 24 can be included in the molding 22 and filled, packed, or blocked with a disintegrable material 26, e.g., in the form of a plug, blockage, etc. The material 26 can be made of disintegrable powder compact material that disintegrates upon exposure to a fluid to open the channel 24 for enabling the fluid to reach and degrade the surface 40 of the substrate material 14 without the milling or drilling operation mentioned above. Any number of channels 24 could be included in the molding 22, and the channel 24 could take any size, shape, or orientation with respect to the molding 22.

Figure 10:
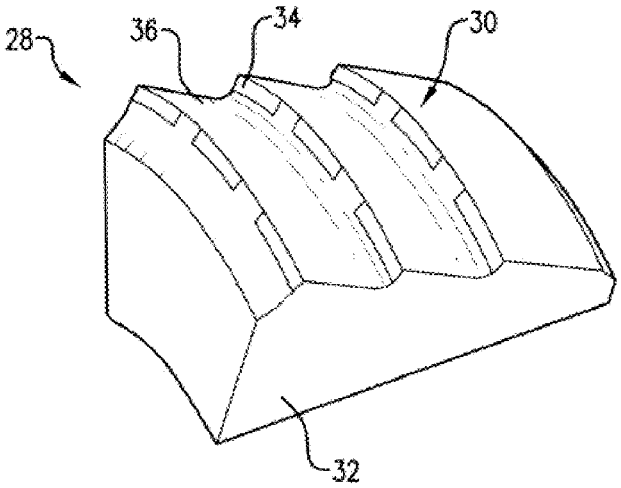
FIG. 10 is a perspective view of a slip element according to an embodiment herein.

Another way to minimize an amount of material that is left downhole is proposed with reference to FIG. 10. In the embodiment of FIG. 10, a slip element 28 is shown substantially resembling the element 10, i.e., having an outer surface 30 of a disintegrable substrate 32. However, the slip element 28 has a plurality of biting elements 34 disposed at the outer surface 30 on each tooth 36. The biting elements 34 may be made of a harder disintegrable powder compact material, e.g., a surface hardened product of the disintegrable powder compact of the substrate 32, for enabling the aforementioned ability to bite into a wall of a tubular. In the embodiment of FIG. 10, the elements 34 take the form of plates, although the biting elements 34 could have other forms or be replaced by other members, e.g., plates with L-cross-sections disposed on the tips of the teeth 36, insertable buttons or other elements, etc. For example, see U.S. Pat. No. 5,984,007 (Yuan et al.), which patent is hereby incorporated by reference. Since the biting elements 34 provide the requisite hardness for anchoring the slip, the hardness of the material forming the outer surface 30 is less important than in the embodiments discussed above. Additionally, the elements 34 can be formed in the same powder metallurgy processing as that forming the outer surface 30 (e.g., compaction in a mold), and can therefore be manufactured more cheaply and easily than separately manufacturing the substrate 32 and elements 34 and then having to join them.

A factor that impacts the selectively tailorable material and chemical properties of the slip or other article made from the disintegrable powder compact is the constituents of the disintegrable powder compact, i.e., the metallic matrix or the dispersed particle disposed in the matrix. The compressive and tensile strengths and disintegration rate are determined by the chemical identity and relative amount of these constituents as well as the difference in their respective standard electrode potentials. Thus, these properties can be regulated by the constituents of the disintegrable powder compact.

According to an embodiment, a process for removing the slip includes contacting the slip with a disintegrating fluid and non-mechanically removing the slip from its location. Such removal includes disintegrating the slip by contacting the implant with a fluid that can include brine or other downhole fluids. Thus, unlike corrosion-resistant downhole tools, the disintegrable article disintegrates in situ in contact with the fluid so that the article does not need to be removed by a subsequent operation.

The disintegrable powder compact, articles, and methods herein are further illustrated by the following non-limiting example.

Example. A disintegrable powder compact was prepared by combining 50 wt % Cr—Mo steel with 50 wt % Mg—Zn alloy (based on the total weight of the powder particles) into an attritor mill followed by milling and mixing therein. The resultant mixture was transferred to a mold and subjected to compaction at a pressure of 30 ksi for 5-15 minutes at room temperature to form a preform. The preform was subsequently sintered and forged at 350° C.-500° C. for 60-120 minutes to form a disintegrable powder compact cylinder having a diameter of 4 inches and length of 5 inches, weight of 3060 grams, and theoretical density of 2.97 g/cm$^3$. A scanning electron micrograph of a sample of the cylinder is shown in FIG. 3, which shows the ferrous alloy as light colored spheres dispersed within a matrix of Mg—Zn alloy as the darker material in the micrograph.

The cylinder was machined to provide a coupon having a 0.5 inch diameter and 1 inch length with an initial weight of 11 g. The coupon was subjected to disintegration testing by immersing the coupon in a vessel filled with an aqueous solution of 3 wt % KCl, based on the weight of the solution, held at 200° F. (93° C.) at 1 atmosphere. As the coupon disintegrated, its mass loss and dimensions were determined periodically over a total time of 24 hours by weighing the dry coupon and measuring the length and diameter of the coupon. Between measurements, the coupon was returned to the vessel for further disintegration. For example after 4 hours, the weight of the coupon was 4.55 g. The average rate of disintegration (corrosion) of the coupon was 160 mg/cm$^2$/hour. Comparatively, under identical conditions, the disintegration rates of a sample of pure Cr—Mo steel and a sample of pure Mg—Zn alloy respectively are about 0 mg/cm$^2$/hour and 1 mg/cm$^2$/hour.

A second coupon of the disintegrable powder compact was subjected to mechanical testing. The disintegrable powder compact had a compressive strength of 60±5 ksi (as forged/annealed) and 90±5 ksi after solution treatment and aging.

While one or more embodiments have been shown and described, modifications and substitutions may be made thereto without departing from the spirit and scope of the invention. Accordingly, it is to be understood that the present invention has been described by way of illustrations and not limitation. Embodiments herein can be used independently or can be combined.

All ranges disclosed herein are inclusive of the endpoints, and the endpoints are independently combinable with each other. The ranges are continuous and thus contain every value and subset thereof in the range. Unless otherwise stated or contextually inapplicable, all percentages, when expressing a quantity, are weight percentages. The suffix "(s)" as used herein is intended to include both the singular and the plural of the term that it modifies, thereby including at least one of that term (e.g., the colorant(s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like.

As used herein, "a combination thereof" refers to a combination comprising at least one of the named constituents, components, compounds, or elements.

All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." It should further be noted that the terms "first," "second," "primary," "secondary," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity). The conjunction "or" is used to link objects of a list or alternatives and is not disjunctive; rather the elements can be used separately or can be combined together under appropriate circumstances.

What is claimed is:

1. A slip element, comprising:

a substrate formed from a sintered powder compact degradable upon exposure to a fluid;

an outer surface disposed on the substrate; and a graded layer disposed between the outer surface and the substrate;

wherein the sintered powder compact comprises:

a matrix comprising a matrix material, the matrix material comprising aluminum, calcium, cobalt, copper, magnesium, manganese, molybdenum, nickel, silicon, zinc, a rare earth element, or a combination thereof;

a plurality of dispersed particles comprising a particle core material dispersed in the matrix, the particle core material comprising a ferrous alloy which comprises carbon, the matrix being continuous and comprising a network that substantially surrounds the dispersed particles;

the matrix and the plurality of dispersed particles having different standard electrode potentials.

2. The slip element of claim 1, wherein the outer surface comprises a surface hardened material provided by surface treating the substrate.

3. The slip element of claim 2, wherein the outer surface comprises a surface hardened product of the matrix and dispersed particles formed in response to subjecting the disintegrable powder compact to carburizing, nitriding, carbonitriding, boriding, flame hardening, induction hardening, laser beam hardening, electron beam hardening, hard chromium plating, electroless nickel plating, thermal spraying, weld hardfacing, ion implantation, or a combination thereof.

4. The slip element of claim 1, wherein the outer surface further comprises a coating.

5. The slip element of claim 1, wherein the graded layer is a functionally graded surface hardened layer transitioning from the substrate to the outer surface.

6. The slip element of claim 1, further comprising a biting element disposed on or extending from the outer surface.

7. The slip element of claim 6, wherein the biting element is provided on at least one tooth of the slip element.

8. The slip element of claim 1, wherein the dispersed particles further comprise a coating disposed on the particle core material;

the matrix and coating have different standard electrode potentials; and the coating and particle core material are different from each other.

9. The slip element of claim 8, wherein the coating completely surrounds the particle core material and blocks contact between the particle core material and the matrix.

10. The slip element of claim 1, wherein the sintered powder compact further comprises a plurality of secondary particles dispersed in the matrix, the secondary particles comprising aluminum, calcium, cobalt, copper, iron, magnesium, manganese, molybdenum, nickel, silicon, tungsten, zinc, a rare earth element, ferrous alloy, an oxide thereof, nitride thereof, carbide thereof, intermetallic compound thereof, cermet thereof, or a combination thereof.

11. The slip element of claim 1, wherein the ferrous alloy is present in an amount from 5 wt % to 95 wt %, and the matrix material is present in an amount from 5 wt % to 95 wt %, each based on a weight of the sintered powder compact.

12. The slip element of claim 1, wherein the sintered powder compact is free of metal nitrides.

13. A slip assembly comprising the slip element of claim 1 disposed in a molding.

14. The slip assembly of claim 13, wherein the molding has at least one channel extending through the molding to the substrate, the channel at least partially filled with the sintered disintegrable powder compact.

15. A process for removing a slip element of claim 1, the process comprising:

contacting the slip element with the fluid that degrades the sintered powder compact.

16. The process of claim 15, wherein the slip element further comprises a biting element which comprises a surface hardened product of the matrix and dispersed particles formed in response to carburizing, nitriding, carbonitriding, boriding, flame hardening, induction hardening, laser beam hardening, electron beam hardening, hard chromium plating, electroless nickel plating, thermal spraying, weld hardfacing, ion implantation, or a combination thereof.

* * * * *